US006371699B1

(12) United States Patent
Weinreb

(10) Patent No.: US 6,371,699 B1
(45) Date of Patent: Apr. 16, 2002

(54) ANCHORED RETAINING WALL SYSTEM

(75) Inventor: Daniel Weinreb, Mississauga (CA)

(73) Assignee: Durisol Inc., Hamilton (CA)

( * ) Notice: Subject to any disclaimer, the term of this patent is extended or adjusted under 35 U.S.C. 154(b) by 0 days.

(21) Appl. No.: 09/529,601

(22) PCT Filed: Oct. 14, 1998

(86) PCT No.: PCT/CA98/00961

§ 371 Date: Apr. 17, 2000

§ 102(e) Date: Apr. 17, 2000

(87) PCT Pub. No.: WO99/20846

PCT Pub. Date: Apr. 29, 1999

Related U.S. Application Data

(60) Provisional application No. 60/062,218, filed on Oct. 16, 1997.

(51) Int. Cl.[7] ..... E02D 29/02

(52) U.S. Cl. ..... 405/262; 405/285; 405/286

(58) Field of Search ..... 405/262, 289, 405/285, 286

(56) References Cited

U.S. PATENT DOCUMENTS 3,381,483 A * 5/1968 Huthsing, Jr. ..... 405/285
3,686,873 A * 8/1972 Vidal ..... 405/262
3,728,862 A * 4/1973 Meredith ..... 405/285
4,325,457 A * 4/1982 Docherty et al. ..... 181/210
4,448,571 A * 5/1984 Eckels ..... 405/284
4,494,892 A * 1/1985 Wojciechowski ..... 405/286
4,790,690 A * 12/1988 Vidal et al. ..... 405/262
4,804,299 A * 2/1989 Forte et al. ..... 405/285
4,913,594 A * 4/1990 Sigourney ..... 405/285
5,158,399 A * 10/1992 Flores ..... 405/285
5,368,416 A * 11/1994 Cataldo ..... 405/285
5,399,057 A * 3/1995 Cunic ..... 405/285
5,419,659 A * 5/1995 Mercer ..... 405/262
5,435,669 A * 7/1995 Weber ..... 405/284
5,531,547 A * 7/1996 Shimada ..... 405/262
5,558,470 A * 9/1996 Elmore et al. ..... 405/262

* cited by examiner

*Primary Examiner*—David Bagnell
*Assistant Examiner*—Frederick L. Lagman
(74) *Attorney, Agent, or Firm*—Patrick J. Hofbauer

(57) ABSTRACT

A retaining wall system (20) comprises at least one wall panel (24) and two vertical frame members (40), each frame member (40) having a web (56), two flanges (54) and an end secured within the ground. Each wall panel (24) has a face (28) with a plurality of mounting brackets (38) protruding therefrom, and is supported in mechanically retained vertical orientation between the flanges (54) of adjacent frame members (40). A plurality of connectors (46), each having a proximal end (48) secured to a respective one of said mounting brackets (38) and extending horizontally therefrom to a distal end (50) secured to a respective one of a plurality of anchors (52) is also disclosed. Optionally, a plurality of Jersey barrier panels (106) or acoustic panels are similarly mechanically retained to form a Jersey barrier or acoustic barrier, respectively. Further is disclosed a method for erecting a retaining wall according to the invention.

32 Claims, 11 Drawing Sheets

ANCHORED RETAINING WALL SYSTEM

This appln. is a 371 of PCT/CA98/00961 filed Oct. 14, 1998 which claims benefit of Prov. No. 60/062,218 filed Oct. 16, 1997.

FIELD OF THE INVENTION

The present invention relates to stabilized earth structures, such as retaining walls.

BACKGROUND OF THE INVENTION

Wall systems for retaining soil and the like are well known in the prior art, particularly for use in association with the construction of roadways and railways. It is known in the prior art for retaining wall systems to utilize the weight of the retained material to assist in the stabilization of the retaining wall system. It is also known in the prior art for retaining wall systems to be constructed out of mass-produced components, for reasons of economy in purchase and installation. However, known prior art retaining wall systems which utilize the weight of the retained material suffer from, inter alia, unduly high production and installation costs, and a lack of flexibility in use.

An example of such prior art is shown in U.S. Pat. No. 5,127,770 (Ditcher), issued Jul. 7, 1992. In the Ditcher patent, a levelling pad is first installed for the structure. Thereafter, discrete facing panels, preferably precast in concrete, are arranged in stacked coplanar relation. As each course of panels is laid down, interlocking tie-backs with anchors are installed, which lock each panel to the panels adjacent, and the region behind each panel is filled with fill material and compacted. The length of the tie-backs are a function of the height of the wall, with the tie-backs to the lower courses being preferably of greater length than the tie-backs employed in the upper courses, with the longest tie-backs being approximately 80% of the wall height.

Such a design suffers from unduly high costs of production and installation. Firstly, the installation of the levelling pad typically requires that a footing be excavated, that forms be constructed and that concrete be poured into the forms and manually levelled. Such a procedure has high associated costs, both in financial terms and in terms of the time required to complete the installation. In addition, as each course of panels and tie-backs are installed, the wall must be backfilled and compacted, which requires that suitable machinery be available throughout the entire erection process. Further, as the Ditcher invention requires tie-backs to horizontally extend approximately 80% of the wall height, with the longest tie-backs being utilized at the lower courses, additional excavation of the slope to be supported may be required, with further consequential costs. Finally, the Ditcher design teaches the use of cast concrete and reinforcing bar tie-backs, which have significant expense and further complicate the installation of the retaining wall.

It is also known in the art for tie-backs to be used of flexible material. For example, U.S. Pat. No. 4,710,062 (Vidal et al.), issued Dec. 1, 1987, teaches the use of metal tie-back strips for use in stabilised earth structures such as retaining walls. Such an arrangement has beneficial cost consequences, in that metal strip tie-backs are economical to purchase. Unfortunately, however, this design again requires that the strips extend deeply into the fill material, since the gripping friction between the strip and the surrounding fill is utilized to stabilize the retaining wall panels to which the strips are attached. Accordingly, the strips must be exceedingly long to generate sufficient friction within the fill, with associated costs in terms of excavation and fill material.

Further, known retaining wall systems of the Vidal type suffer from susceptibility to slip circle failure. For reasons of economy, known wall systems of this general type typically employ tie-backs which extend through the fill material to a distance beyond the Ranking wedge for the particular retaining wall, which is a wedge commencing at the base of the wall and extending into the fill material at an angle which is a function of the angle of repose of the particular fill material. In such manner, the weight of the stable material beyond the Ranking wedge is used to retain the unstable fill retained therewithin. It is evident that such an arrangement results notionally in a structure of significant mass being created, which incorporates the mass of all of the soil retained by the tie-backs in friction. In abnormal conditions, such as flooding or earth shifting, the entire wall system, including the soil retained by the tie-backs, can shift, although the wall system, per se, does not fail, as the soil continues to be retained behind the retaining wall. Such shifting normally occurs in a circular fashion, with the base of the wall pivoting outwardly, and has proven to be of serious concern.

It has also been found that known retaining wall systems suffer from an inability to conveniently include an unsupported structure above the level of the retained soil. Such a feature would be useful, for example, where a retaining wall is to be installed between divided roadways of different altitudes, and it is desired to incorporate a Jersey-type barrier, of the type described in U.S. Pat. No. 5,406,039 (Rerup et al.), issued Apr. 11, 1995, between the road surfaces; or where a retaining wall is used to support a highway cut, and it is desired to incorporate an acoustic barrier at the ridge. In known prior art retaining wall systems, the erection of such unsupported structures essentially constitutes new construction, requiring appropriate foundations, etc. to be installed. Moreover, such installation is complicated by the inevitable settling of the fill, which necessitates that either additional expense be incurred in more completely compacting the fill material during construction, or that construction of the unsupported above-grade structure be delayed until the fill has had an opportunity to settle.

Further, it has also been found that known retaining wall systems suffer from the presence of tie-backs utilized in the upper courses of the retaining wall, which interfere with normal surface activities, such as tree-planting, underground wiring or piping, etc.

Finally, the installation of known retaining wall systems is also complicated by the requirement that suitable drainage means must be incorporated during construction. Providing such drainage means, and ensuring that same are not damaged during construction, adds further to the costs of installation.

Wall systems of the general type having concrete wall panels inserted in stacked relation between the flanges of pairs of galvanized I-beam support columns, each of which columns being supported in the ground by a respective concrete footing, are known in the acoustical barrier art. Two well-known wall systems of this general type for use as acoustical barriers are shown and is described in detail in U.S. Pat. No. 4,325,457 (Docherty et al.), issued Apr. 20, 1982 and in U.S. Pat. No. 5,406,039 (Rerup et al.), issued Apr. 11, 1995, both of which patents are hereby incorporated by reference. Such acoustical barrier wall systems have some characteristics which are inherently well-suited to adaptation to retaining wall applications, notably, their resistance to slip-circle type failure, more particularly, the concrete footings utilized such acoustical barriers extend beneath same and can, therefore, act as pins, to resist the pivoting of the base of the wall and thereby limiting the likelihood of slip-circle failures. Unfortunately, known acoustical barrier wall systems of this type have proven unsuitable for use as soil retaining walls, particularly where the height of such installations is to exceed several meters. In order to safely support the lateral loads generated by the fill behind a retaining wall having a height of several meters or more, it is necessary to use concrete footings and support columns which are exceedingly large. As the height of such a retaining wall increases, the costs of constructing the necessary concrete footings and support columns rapidly becomes prohibitive.

It is known in the prior art for structures of the Vidal type (referenced in this specification at page 3), to be constructed with a face of posts and panels, such as is taught in U.S. Pat. No. 4,804,299 (Forte et al.). By utilizing the technique of reinforced earth taught, inter alia, in the Vidal reference, the large concrete footings and support columns which would otherwise be required can be avoided. However, this type of construction again suffers in that the reinforcement means extend deeply in the soil, irrespective of the relative height of the reinforcement means, in order that a stable "block" of soil can be created behind the wall panels.

SUMMARY OF THE INVENTION

It is an object of the present invention to overcome, inter alia, the shortcomings of the prior art described above by providing a retaining wall system that is economical to produce and install, that is resistant to slip-circle failure, that has drainage characteristics suitable for most installations, that enables normal surfaces servicing, and that is readily adaptable to the installation of unsupported structures thereupon.

These and other objects are addressed by the present invention, a retaining wall system. In accordance with one aspect of the invention, there is disclosed a preferred embodiment of the retaining wall system which comprises at least one retaining wall panel. Each said wall panel has an exposed face, a fill contacting face, a first lateral end, a second lateral end, an upper panel surface, a lower panel surface and a plurality of mounting brackets protruding from the fill contacting face. The retaining wall system further comprises at least two upright frame members, each of said frame members having a first end secured within the ground and a second end vertically disposed thereto, with the frame members being positioned and dimensioned to support said wall panel in mechanically retained vertical orientation therebetween. The invention further provides a plurality of non-rigid connecting means, each such non-rigid connecting means having a proximal end and a distal end, the proximal end being secured to a respective one of said mounting brackets on the fill contacting face of said wall panel and extending outwardly therefrom to the distal end.

As well, the retaining wall system further comprises a plurality of anchoring means. The distal end of each said connecting means is secured to a respective one of said anchoring means, with each such anchoring means being secured to the distal end of at least a respective one of said non-rigid connecting means.

In accordance with another aspect of the invention, there is also disclosed a first alternative embodiment, additionally comprising a plurality of Jersey-type traffic barrier panels. In this embodiment, each Jersey barrier is adapted for insertion between adjacent frame members, and the plurality of Jersey barriers are positioned atop the retaining wall, separated one from another respectively by said frame members, in lateral end-to-end relation to one another, to form a continuous Jersey barrier of selected lateral length.

In accordance with a further aspect of the invention, there is also disclosed a second alternative embodiment. In the second alternative embodiment, a plurality of Jersey barriers and a plurality of acoustic panels are also provided. In this embodiment, the Jersey barriers are positioned in lateral end-to-end relation to one another to form a continuous Jersey barrier of selected lateral length, with the retaining wall panels being positioned atop same, in vertically stacked relation to one another and to said Jersey barrier, and, separated one from another respectively by said frame members, in lateral relation to one another, to form a retaining wall of selected length and height atop the Jersey barrier. The plurality of acoustic panels are further positioned atop the retaining wall, in vertically stacked relation to one another and to the retaining wall, and, separated one from another respectively by said frame members, in lateral relation to one another, so as to form an acoustic barrier of selected height and length atop the retaining wall.

The invention also comprises a method of erecting the retaining wall system to retain a target volume of fill material. The method comprises the steps of: (a) drilling to a selected depth a plurality of footing holes in seriatim at positions selected to accommodate the installation of a plurality of retaining wall panels of determinate length, each wall panel having a plurality of mounting brackets embedded therein which protrude from a fill contacting face thereof in one or more horizontal rows; (b) pouring fluid concrete into said footing holes to form a corresponding plurality of concrete footings, and thereafter inserting a first end of one of a plurality of I-beam support columns into the fluid concrete in each concrete footing, each I-beam support column having two parallel flanges and a traverse web extending therebetween and being inserted in substantially vertical orientation and directed such that the web of each said I-beam support column is substantially parallel to the web of every other I-beam support column and is substantially normal to a notional wall line defined by the plurality of footing holes; (c) inserting in seriatim said plurality of wall panels, each said wall panel being inserted between the flanges of adjacent I-beam support columns and oriented such that the fill contacting face of the wall panel faces towards the volume to be filled, said plurality of wall panels forming a retaining wall of selected length and height having a slope facing side defined by the plurality of fill contacting faces of the wall panels; (d) installing and compacting a first layer of fill material against the slope facing side of the retaining wall to the approximate horizontal level of a selected row of said mounting brackets chosen for the securement of a plurality of non-rigid connecting means; (e) securing a proximal end of each non-rigid connecting means to a respective mounting bracket in said selected row of mounting brackets; (f) securing the distal end of each non-rigid connecting means to a respective one of said anchoring means, such that each anchoring means is secured to at least a respective one of said non-rigid connecting means; (g) installing and compacting a layer of fill material against the slope facing side of the retaining wall to a level above the non-rigid connecting means so secured; (h) sequentially repeating steps (e) through (g) until the target volume of fill material is retained behind the retaining wall system; (i) optionally, inserting a plurality of Jersey barriers atop the retaining wall in vertically stacked relation thereto between the flanges of adjacent I-beam support columns to form a continuous Jersey barrier of selected length, or inserting a plurality of wall panels atop a Jersey barrier in vertically stacked relation thereto between the flanges of adjacent I-beam support columns to form a retaining wall of selected length and height, and thereafter inserting a plurality of acoustic barrier panels atop the retaining wall in vertically stacked relation thereto to form a an acoustic barrier of selected height and length.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

DETAILED DESCRIPTION OF A PREFERRED EMBODIMENT

Figure 1:
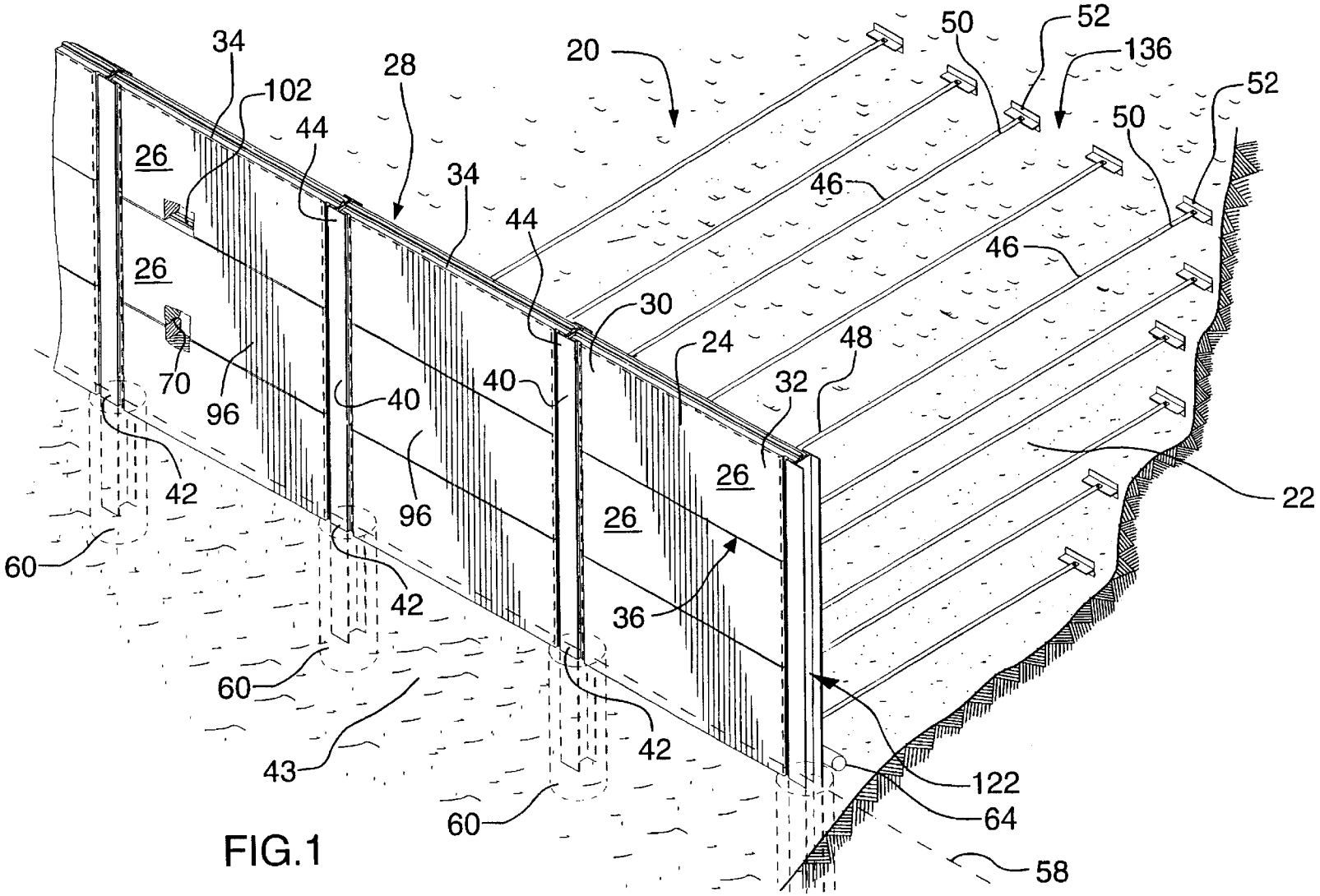
FIG. 1 is a perspective view of a preferred embodiment of a retaining wall system according to the present invention.
Figure 2:
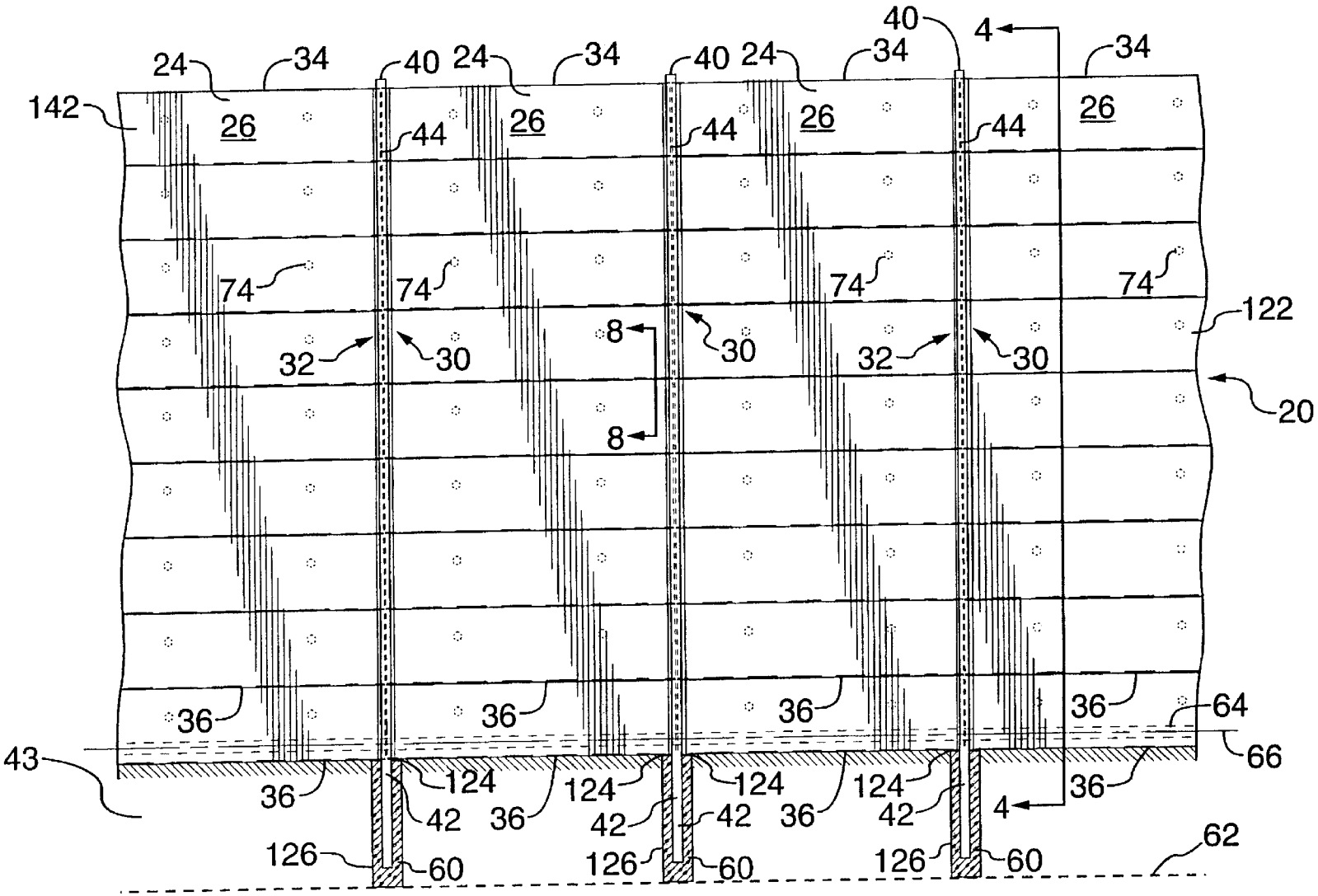
FIG. 2 is a partial elevational view of the retaining wall system of FIG. 1.

Referring now to FIGS. 1 through 9A of the drawings, a preferred retaining wall system for use with granular fill 22 according to the present invention is disclosed, which retaining wall system is designated by the general reference numeral 20. The retaining wall system 20 comprises at least one wall panel 24 having an exposed face 26, a fill contacting face 28, a first lateral end 30, a second lateral end 32, an upper panel surface 34, a lower panel surface 36, and a plurality of mounting brackets 38 protruding from the fill contacting face 28, which are shown most clearly in FIGS. 9A and 9B. The retaining wall system 20 further comprises at least two upright frame members 40, each of said frame members 40 having a first end 42 secured within the ground 43, and a second end 44 vertically disposed thereto, said frame members 40 being positioned and dimensioned to support said wall panel 24 in mechanically retained vertical orientation therebetween. The invention further comprises a plurality of connecting means 46, each such connecting means having a proximal end 48 secured to a respective one of said mounting brackets 38 on the fill contacting face 28 of the wall panel 24 and extending outwardly therefrom to a distal end 50. A plurality of anchoring means 52 are also disclosed. The distal end 50 of each such connecting means 46 is secured to a respective one of said plurality of anchoring means 52, and each such anchoring means 52 is secured to the distal end 50 of at least a respective one of said connecting means 46. Typically, of course, as can be seen in FIG. 1, the retaining wall system 20 is constructed using a plurality of wall panels 24, positioned in vertically stacked relation to one another and, separated one from another respectively by a plurality of said frame members 40, in lateral relation to one another, so as to form a retaining wall 122 of selected lateral length and height for a chosen application.

Figure 3:
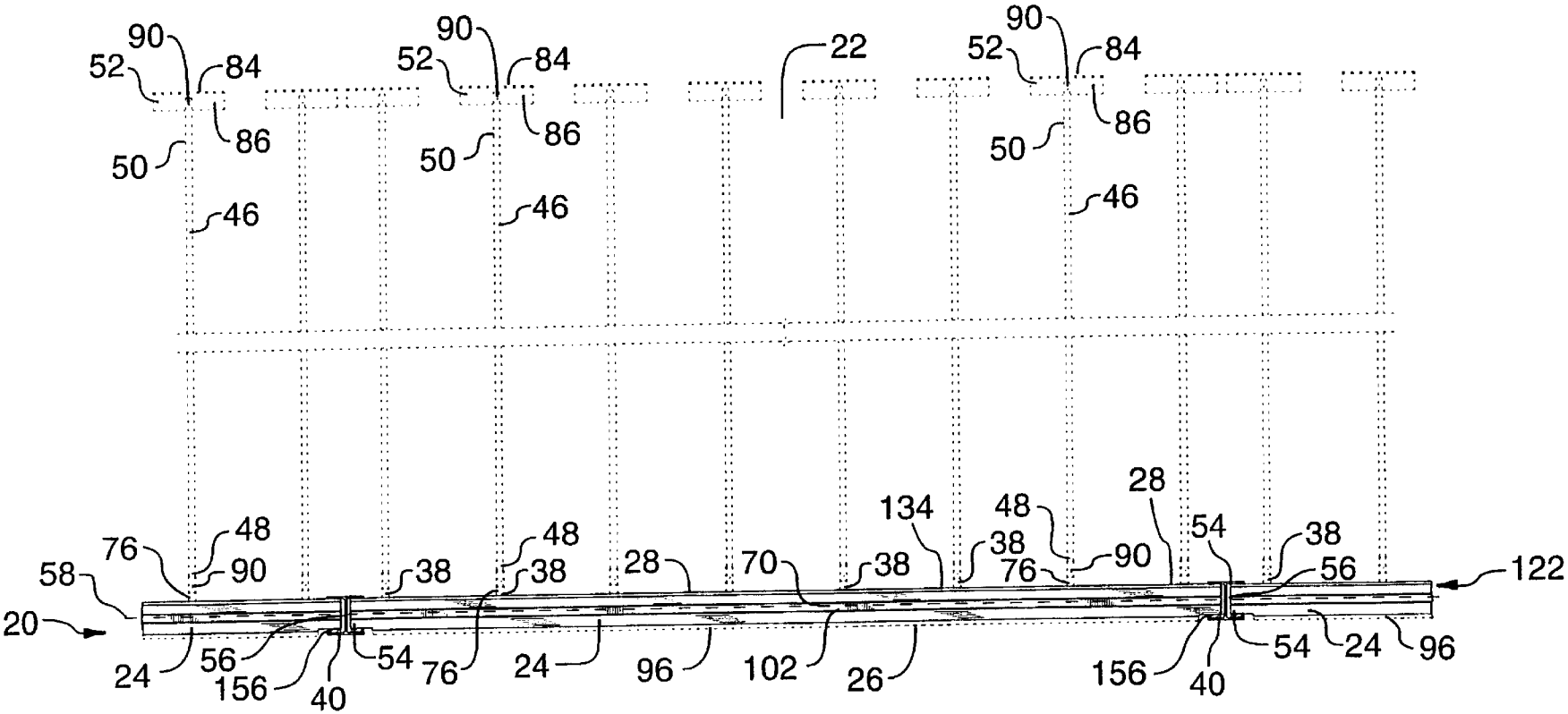
FIG. 3 is a partial plan view of the retaining wall system of FIG. 1.
Figure 5:
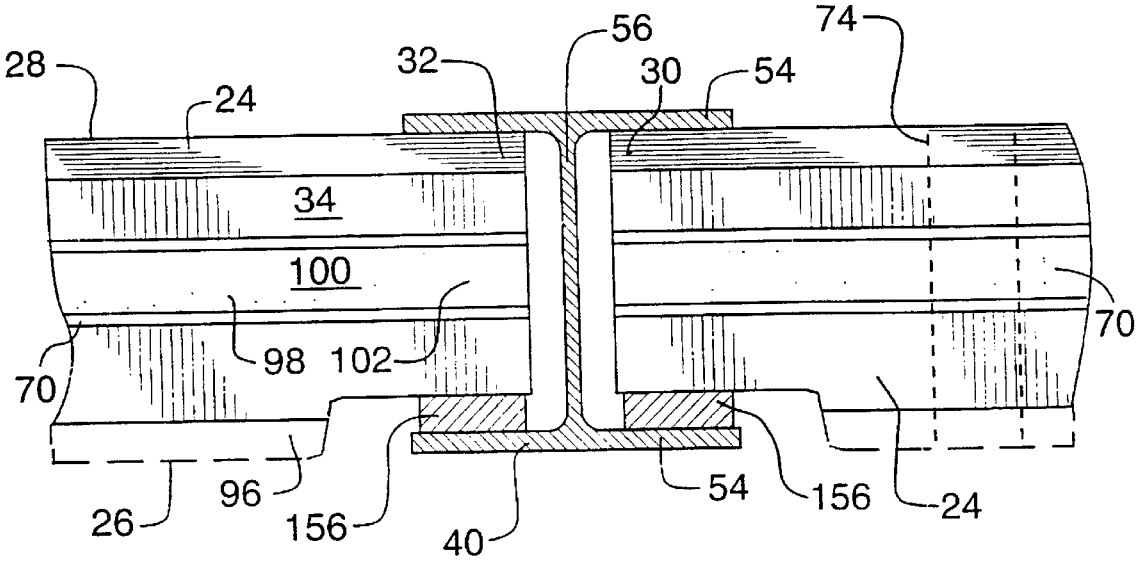
FIG. 5 is an enlarged vertical sectional view of the encircled area 5 of FIG. 3 showing the manner in which the wall panels are retained within the flanges of the frame members.

The upright frame members 40 utilized are preferably I-beam support columns, although other cross sectional configurations may be employed. As best seen in FIGS. 3 and 5, each said frame member 40 has two parallel flanges 54 and a transverse web 56 extending therebetween, and is positioned such that its web 56 is substantially parallel to the web 56 of every other frame member 40 and is substantially normal to a notional wall line 58 defined by the plurality of frame members 40.

As indicated, the frame members 40 have a first end 42 secured within the ground 43. The respective first ends 42 of the frame members 40 are so secured by containment within concrete footings 60. With careful calculations, being conducted in accordance with known engineering principles having regard to the construction of the retaining wall 122, the nature of the fill 22 and surrounding ground 43, the number and nature of the anchoring means 52 employed and the purposes for which the retaining wall 122 is installed, the depth and diameter of the concrete footings 60 are selected such that same extend beneath a notional slip circle radius 146 for the wall system 20 that provides acceptable design levels of stability with respect to slip circle type failure.

Figure 4:
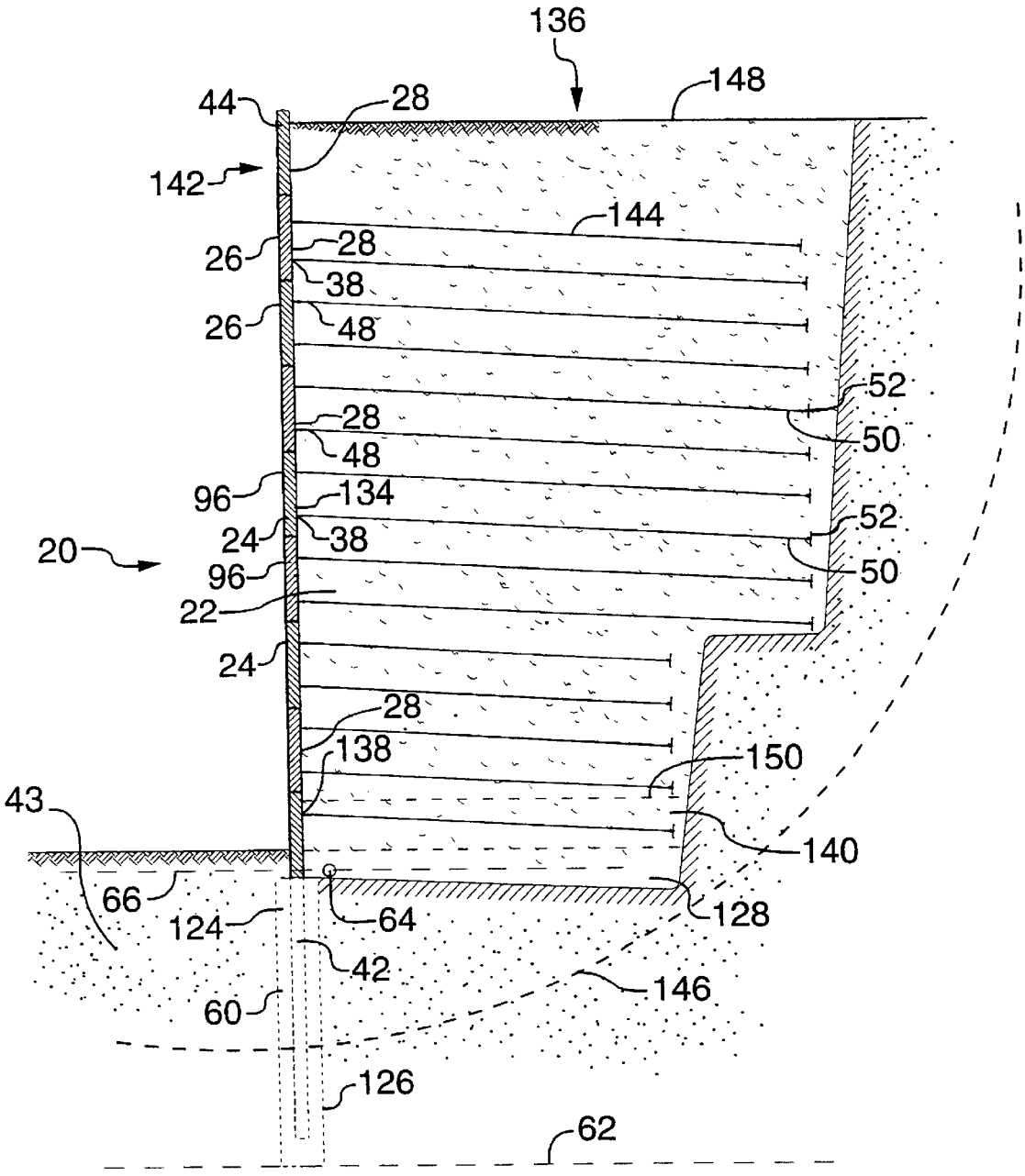
FIG. 4 is sectional view taken along line 4—4 of FIG. 2.

As best seen in FIGS. 3 and 4, there is also provided a continuous network of drainage piping 64 adjacent to said notional wall line 58 and at a horizontal level 66 adjacent an upper end 124 of the concrete footing 60 of each frame member 40.

The retaining wall panels 24 are preferably cast from cementitious material, preferably Portland cement.

Figure 6:
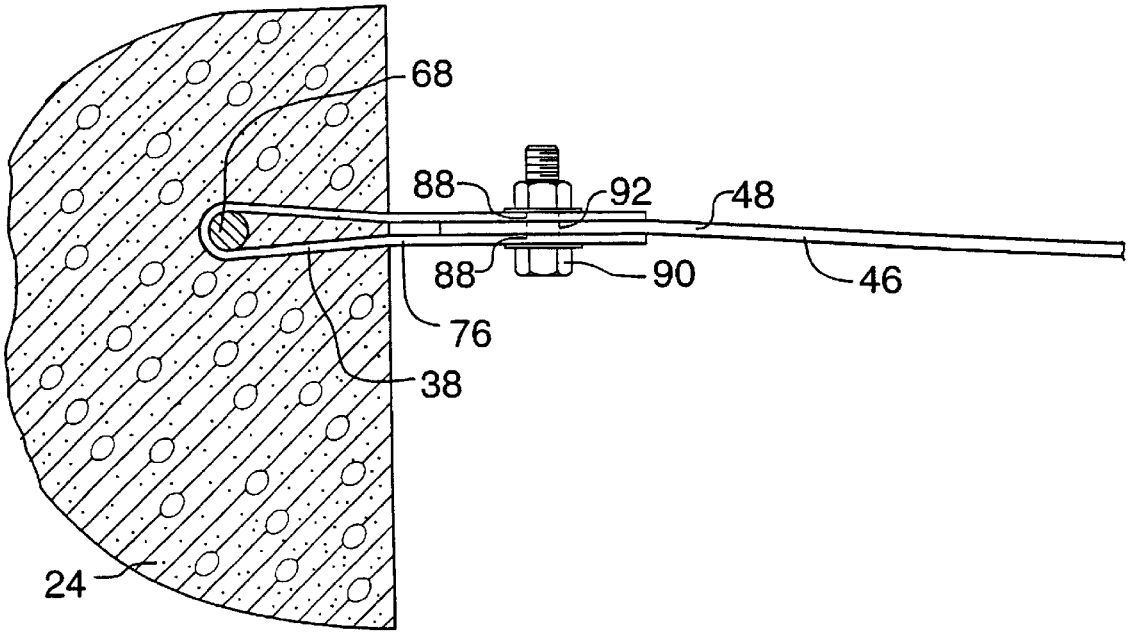
FIG. 6 is an enlarged view of the encircled area 6 of FIG. 4 showing the mounting brackets in greater detail.
Figure 7:
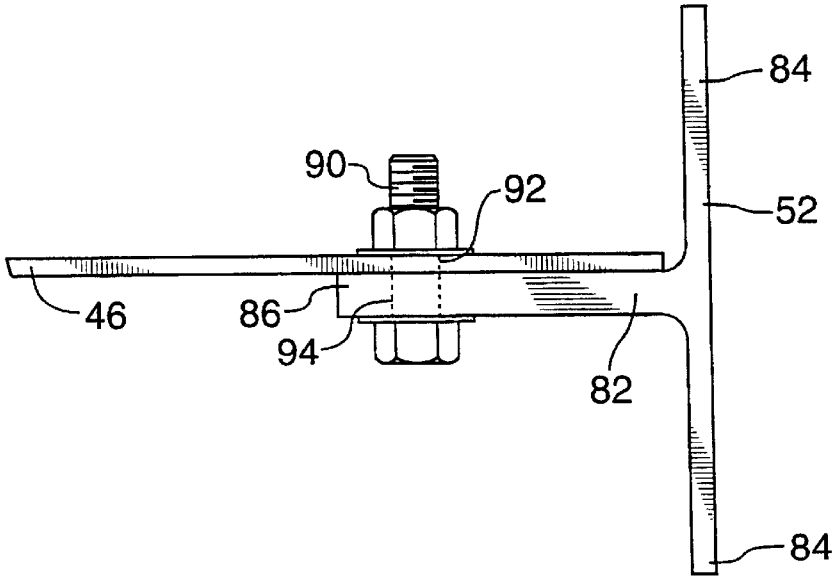
FIG. 7 is an enlarged view of the encircled area 7 of FIG. 4 showing the anchoring means in greater detail.
Figure 8B:
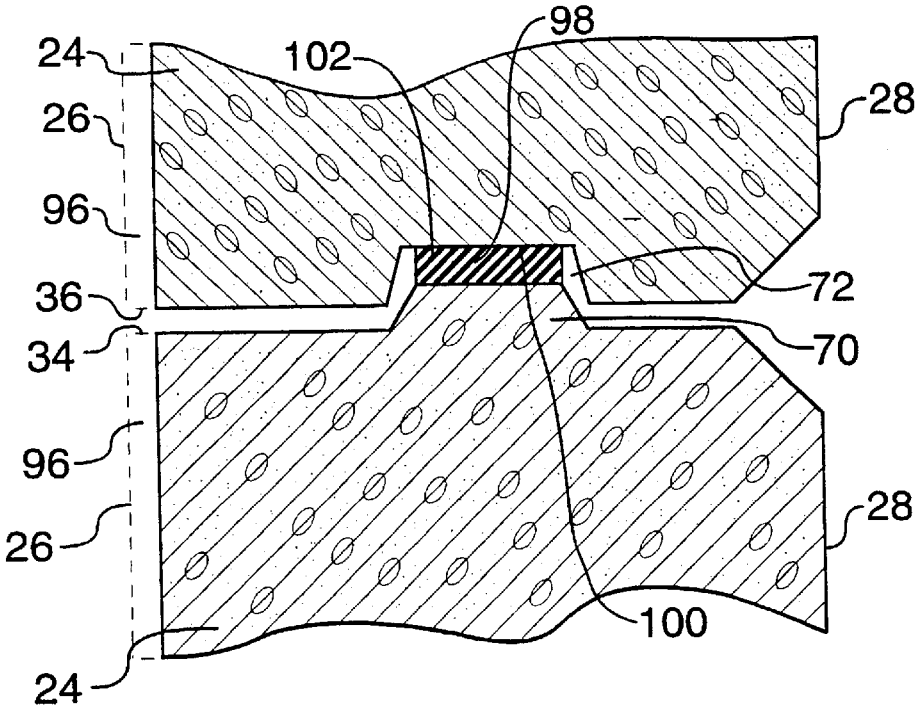
FIG. 8B is a sectional view similar to FIG. 8A, showing vertically adjacent wall panels before compression.
Figure 8A:
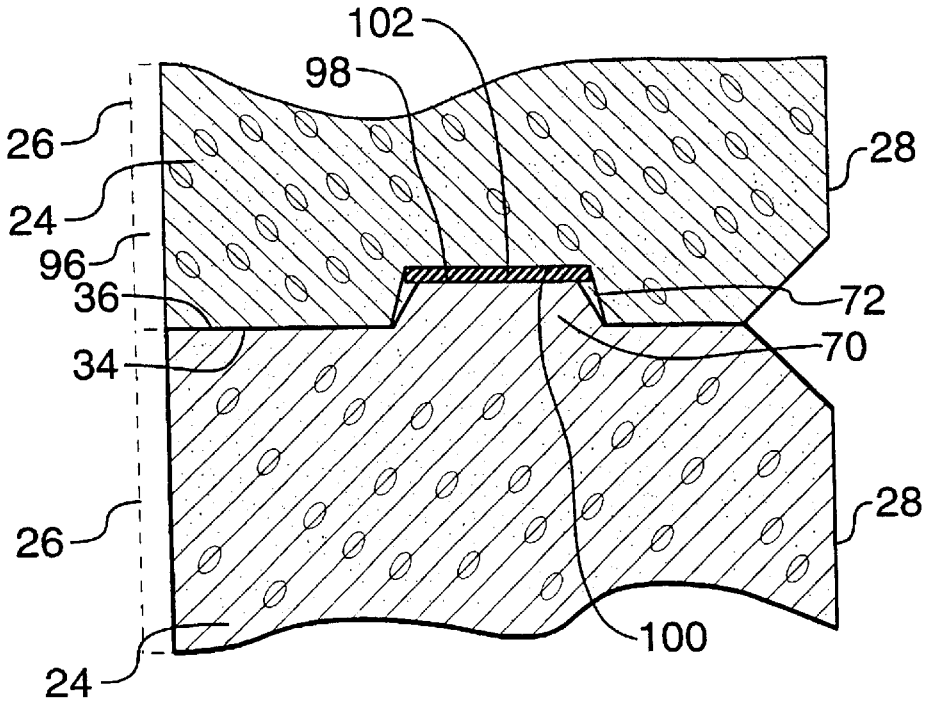
FIG. 8A is a sectional view taken along line 8—8 of FIG. 2 showing the manner in which vertically adjacent wall panels engage one another.

In the preferred embodiment of the present invention shown in FIGS. 1 through 9A, the wall panels 24 comprise a face layer 96 of chemically mineralized and neutralized fibres blended with Portland cement, incorporated in the exposed face 26 of the wall panel 24 and cast contiguously therewith, as best seen in FIGS. 4, 8A and 8B. The use of chemically mineralized and neutralized fibres blended with Portland cement is taught in U.S. Pat. No. 4,325,457 (Docherty et al.), issued Apr. 20, 1982, and such material is commercially available under the trade-mark DURISOL® from Durisol Materials Limited, of Hamilton, Ontario, Canada. The incorporation of such a layer 96 is preferable, in that the DURISOL® material has beneficial sound absorption qualities, good aesthetic appearance, and is resistant to mildew and rot formation, as is well known in the construction arts. Further, the DURISOL® material also has insulating qualities which reduce the depth of frost penetration into the fill material 22, and therefore, reduce stresses on the wall system 20 caused by expansion and contraction. However, the wall panels 24 can be constructed without this DURISOL® face layer 96, particularly where sound absorption is not a high priority in the subject application.

A further preferred feature of the wall panels 24 is the provision of weeping means 74 therein to permit controlled drainage of moisture from the fill contacting face 28 to the exposed face 26 of the wall panel 24, without significant loss of the granular fill 22. In the present embodiment, the weeping means 74 preferably comprises two plugs 74 per wall panel of chemically mineralized and neutralized fibres blended with Portland cement, cast contiguously with the wall panel 24 and extending therethrough from the fill contacting face 28 to the exposed face 26. Such plugs 74 are best seen in FIGS. 5 and 8, wherein they appear in phantom outline. The use of DURISOL® material is particularly advantageous in this application, as the material is similar in appearance to Portland cement, and consequently, the weeping means 74 are not visually apparent, enhancing the aesthetics of the retaining wall system 20. The wall panels 24 could be constructed entirely from DURISOL® material. However, such application is not necessary to achieve sound absorption and drainage objectives, and is not preferred.

Said wall panels 24 are retained in their respective positions from lateral movement by the webs 56 of adjacent frame members 40 and retained from movement away from said notional wall line 58 by the flanges 54 of said frame members 40, as best seen in FIG. 5. In the preferred embodiment, spacers 156 are also provided, which are vertically positioned abutting the exposed faces 26 of the wall panels 24, adjacent their first 30 and second lateral ends 32, as seen in FIG. 5. Such spacers 156 are not strictly required, however, the use of same allows for additional clearance between the parallel flanges 54 and the wall panels 24, assisting in the installation of the retaining wall system 20, as will be described more fully below.

Figure 9A:
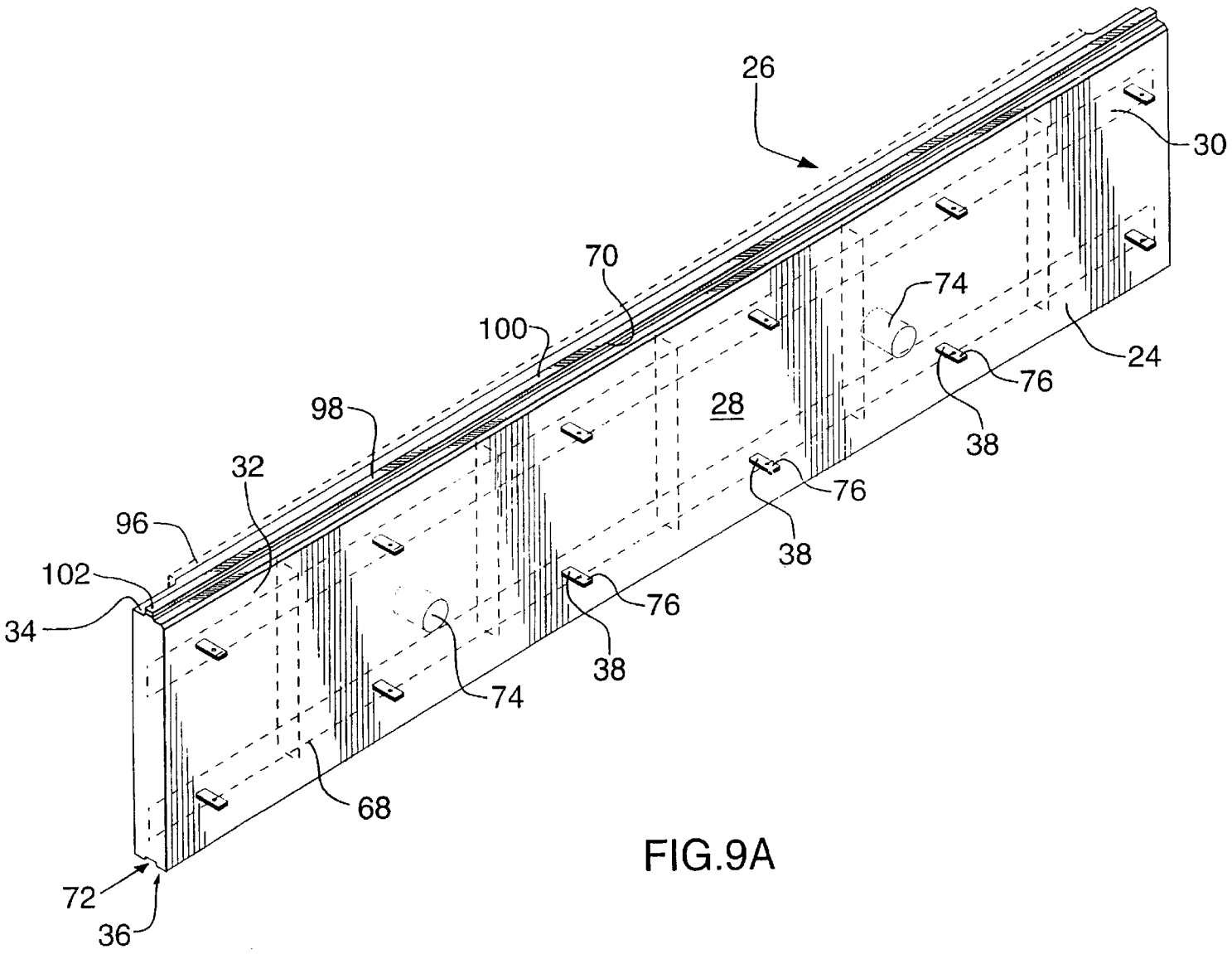
FIG. 9A is a perspective view of a wall panel for use in a preferred embodiment of the present invention.
Figure 9B:
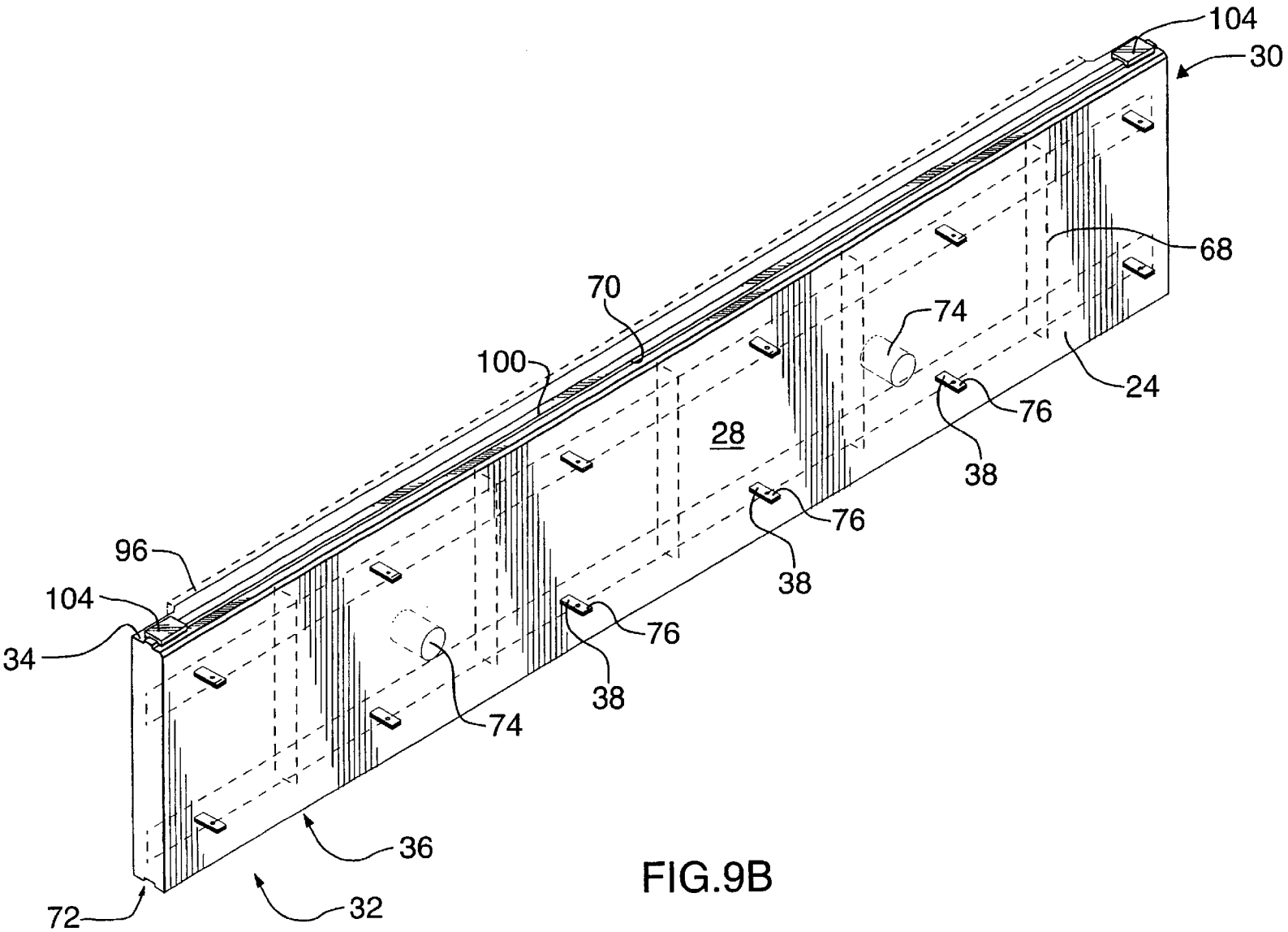
FIG. 9B is a perspective view of an alternative construction of a wall panel for use in the present invention.

The retaining wall panels 24 are preferably constructed with a plurality of reinforcing means 68 positioned therein, which in the preferred embodiment shown, is a grid of conventional reinforcing bar 68, as best seen in FIGS. 9A and 9B, wherein said reinforcing means 68 appear in phantom outline.

In addition, as best seen in FIGS. 4, 8 and 9A, each wall panel 24 preferably has an upwardly disposed panel tongue 70 extending along its upper panel surface 34, and a corresponding panel groove 72 extending along its lower panel surface 36, the panel tongues 70 and panel grooves 72 being rigidly engageable one with the other. It will be appreciated that this feature imparts an additional measure of rigidity to the retaining wall 122. However, such rigidity is not strictly required, the primary purpose of this feature being to arrest the flow of moisture through the retaining wall 122 between vertically adjacent wall panels 24 to prevent loss of fill material 22.

As best seen in FIG. 6, the mounting brackets 38 each comprise a metal tie 38 embedded within the wall panel 24 in mechanically retained wrapped engagement around at least one of said plurality of reinforcing means 68 positioned therein, each said mounting bracket 38 having a protruding end 76 protruding from the retaining wall panel 24. The number of mounting brackets 38 per retaining wall panel 24 is selected as a matter of strength characteristics, using known engineering principles having regard to materials strengths and retaining wall 122 construction, and of manufacturing convenience. As best seen in FIG. 9A, it is preferable to position the mounting brackets 38 in discrete horizontal rows along the wall panels 24 in order to facilitate filling in sequential layers during the installation of the retaining wall system 20 (as will be discussed further below).

In the preferred embodiment illustrated, the connecting means 46 comprise metal straps 46 being flat in cross-section, as best seen in FIGS. 6 and 7. However, other connecting means could be utilized, such as conventional reinforcing bar (not shown).

There is also disclosed anchoring means 52, best viewed in FIG. 7. In the preferred embodiment shown, each said anchoring means 52 comprises a bar of substantially T-shaped cross-section 82 having two parallel anchoring flanges 84 oriented normally to a connecting flange 86.

In the preferred embodiment, the connecting means 46 are secured to the mounting brackets 38 and to the anchoring means 52 by first fastening means 90, comprising bolts 90, openings 88, 92 and 94 being sized and dimensioned to receive bolts being provided, respectively, adjacent to the protruding ends 76 of the mounting brackets 38, adjacent the proximal 48 and distal ends 50 of the connecting means 46, and centrally disposed upon the connecting flanges 86. However, other conventional manners of securing same could be utilized, such as rivets.

In the preferred embodiment, the distal end 50 of each connecting means 46 is secured to a respective one of said anchoring means 52 by a first fastening means 90, with said distal end 50 operatively abutting an anchoring flange 84 so as to prevent pivotal rotation of said anchoring means 52 about said first fastening means 90.

It is preferable that the connecting means 46, mounting brackets 38, anchoring means 52, frame members 40, spacers 156 and first fastening means 90 be constructed out of galvanized metal, for strength and corrosion resistance.

In the preferred embodiment of the present invention, there is further provided compression means 98 positioned between vertically adjacent wall panels 24.

As best seen in FIGS. 8A, 8B and 9A, said compression means 98 preferably comprises a seam bearing pad 102 which is incorporated in an upper tongue surface 100 of the panel tongue 70, said seam bearing pad 102 being preferably constructed from DURISOL® and contiguously cast with the wall panel 24. The use of DURISOL® in the seam bearing pad 102 has numerous advantages, including water permeability, compressibility, sound absorption and cost advantages, due to its integral casting with the wall panels 24. However, the seam bearing pad 102 can alternatively be constructed from other strong and compressible materials, such as neoprene rubber.

In an alternative construction of the wall panel 24, shown in FIG. 9B, the compression means 98 comprises two end bearing pads 104, said end bearing pads 104 being positioned upon the upper panel surface 34 adjacent to the first lateral end 30 and the second lateral end 32 and being constructed of DURISOL® material. Such an arrangement allows for indirect moisture flow between vertically adjacent wall panels 24, and is only suitable where coarse granular material is used as the fill material 22. Use of the retainer wall panel in this alternate construction with fine granular fill, such as sand (not shown) would require filter material, such as geotextile cloth, to be incorporated at additional cost along the plurality of fill contacting faces to avoid leaching of the fill material. However, such use might be favoured in circumstances where coarse granular fill 22 of certain quality was to be utilized, since such an arrangement would avoid the need for separate weeping means as earlier described. In this construction of the wall panel 24, the compressible end bearing pads 104 may be constructed from DURISOL®, integrally cast with the wall panels 24; however, the only significant benefit of such construction would be in economy of manufacture. Accordingly, the compressible bearing pads 104 may be constructed from other strong and compressible materials, such as neoprene rubber.

Figure 10:
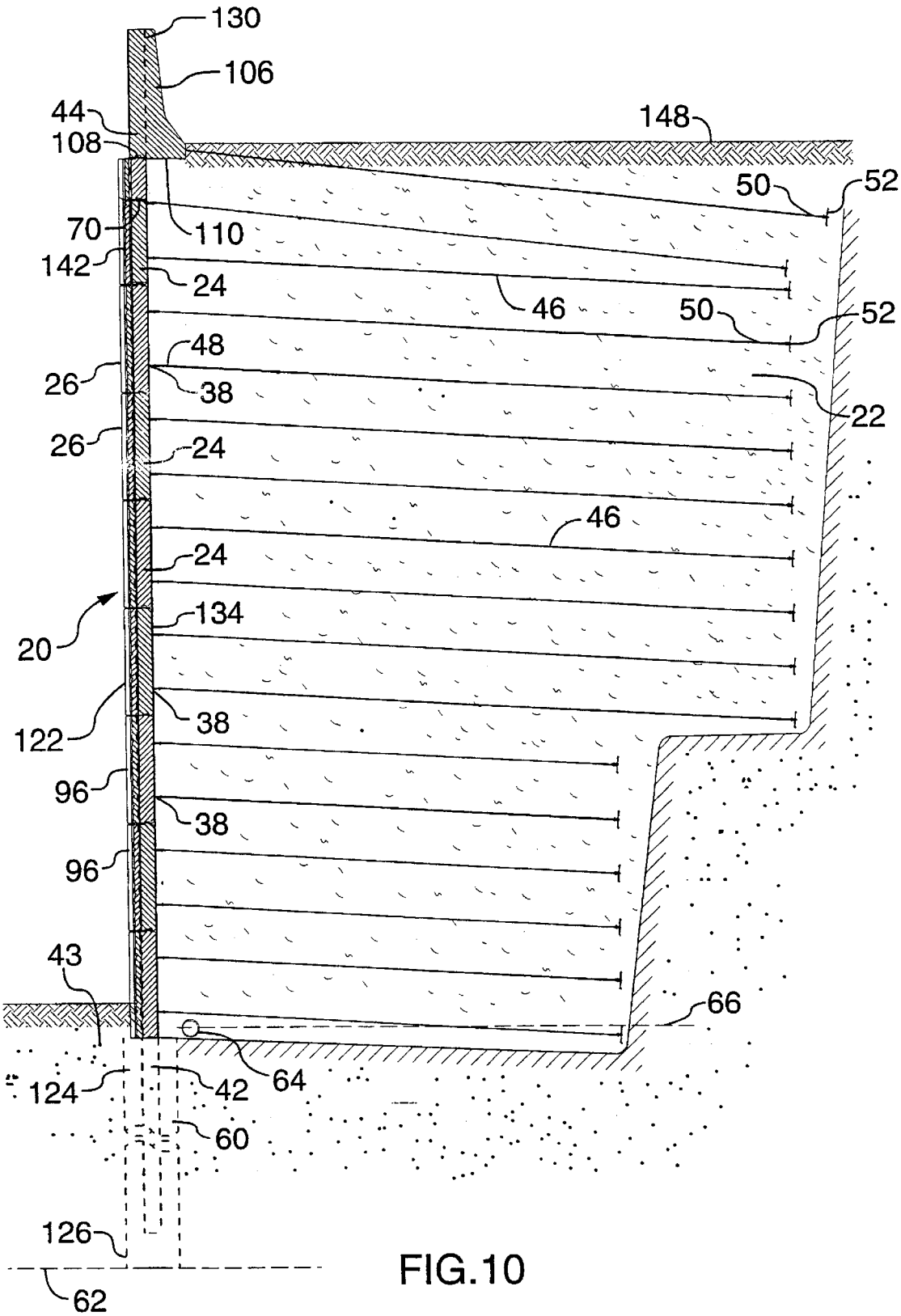
FIG. 10 is a sectional view of a first alternative embodiment of a retaining wall system according to the present invention showing the incorporation of a Jersey-type barrier atop the retaining wall.

In a first alternative embodiment of the present invention, shown in FIG. 10, the retaining wall system 20 further comprises a plurality of Jersey-type traffic barrier panels 106, each said Jersey barrier 106 being adapted for insertion between adjacent frame members 40 and having a Jersey groove 108 extending along a lower Jersey surface 110 thereof, with the said Jersey groove 108 being adapted to rigidly engage with the panel tongues 70 of said wall panels 24. In this embodiment, said Jersey barriers 106 are positioned between adjacent frame members 40 and positioned atop the retaining wall 122 in vertically stacked relation thereto and, separated one from another respective by said frame members, in lateral end-to-end relation to one another, with the panel tongues 70 of wall panels 24 being rigidly engaged respectively with the Jersey grooves 108 of Jersey barriers 106 in vertically stacked adjacent relation thereupon, to form a continuous Jersey barrier 130 of selected lateral length. It is evident that in this embodiment, loads generated by the Jersey barriers 106 are transferred to the wall system 20, and with careful calculations, the need for a separate foundation for the Jersey barrier 130 is avoided.

Figure 11:
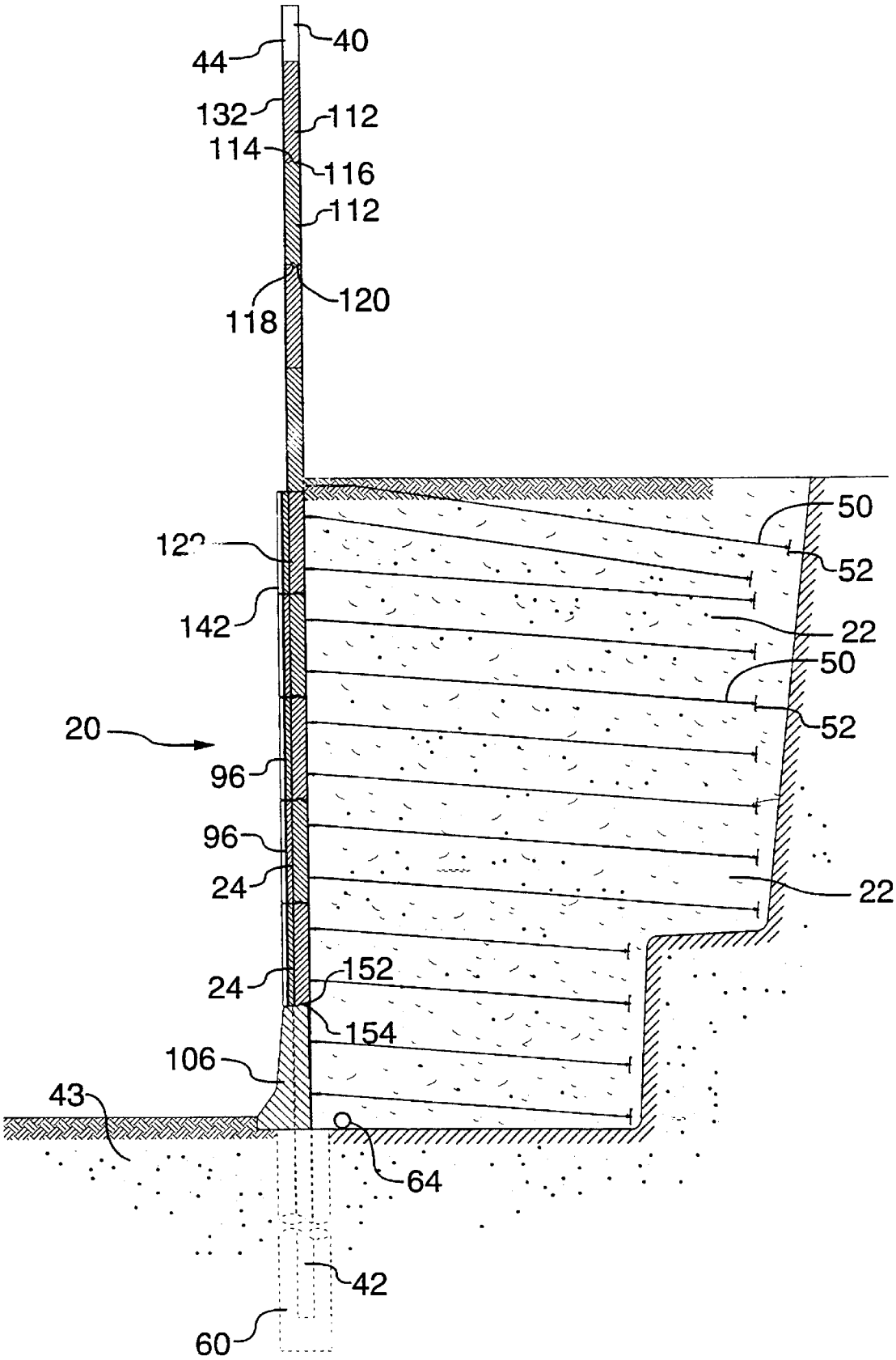
FIG. 11 is a sectional view of a second alternative embodiment of a retaining wall system according to the present invention showing the construction of a retaining wall atop a Jersey barrier, with an acoustic barrier being incorporated atop the retaining wall.

In a second alternative embodiment of the present invention, shown in FIG. 11, the retaining wall system 20 further comprises a plurality of acoustic panels 112 and a plurality of Jersey barriers 106. Each said acoustic panel 112 is adapted for insertion between adjacent frame members 40 and has an upwardly disposed barrier tongue 114 extending along an upper barrier surface 116 thereof, and a corresponding barrier groove 118 extending along a lower barrier surface 120 thereof, with the barrier tongues 114 and barrier grooves 118 being rigidly engageable, and with the barrier grooves 118 and panel tongues 70 being rigidly engageable. Each said Jersey barrier 106 is adapted for insertion between adjacent frame members 40 and has a Jersey tongue 152 extending along an upper Jersey surface 154 thereof, with the Jersey tongues 152 and panel grooves 72 being rigidly engageable. In this second embodiment, the Jersey barriers 106 are positioned in lateral end-to-end relation to one another, separated one from another respectively by said frame members 40, to form a continuous Jersey barrier 130 of selected lateral length, with the retaining wall 122 being positioned atop the Jersey barrier 130 in vertically stacked relation thereto, and said acoustic panels 112 being further positioned atop the retaining wall 122 in vertically stacked relation thereto and to one another, and, separated one from another respectively by said frame members 40, in lateral relation to one another. In this second alternative embodiment, the barrier tongues 114 are rigidly engaged respectively with barrier grooves 118 of acoustic panels in vertically stacked adjacent relation thereupon, the panel tongues 70 of wall panels 24 are rigidly engaged respectively with barrier grooves 118 of acoustic panels 112 in vertically stacked adjacent relation thereupon, and the Jersey tongues 152 are rigidly engaged respectively with panel grooves 72 of wall panels 24 in vertically stacked adjacent relation thereupon, to form an acoustic barrier 132 upon the retaining wall 122 upon the Jersey barrier 130. Similarly, in this embodiment, with careful design of the retaining wall system 20, the need for separate foundations for the acoustic barrier 132 and Jersey barrier 130 is avoided.

While but three embodiments of the present invention are herein shown and described, along with an alternative construction of the wall panel for use therein, it will be understood that various changes in size, shape or arrangement of parts may be made without departing from the spirit of the invention. For example, the acoustic barrier panels of the second alternative embodiment could be positioned in vertically stacked relationship atop the Jersey barrier panels of the first alternative embodiment, inserted between adjacent frame members 40.

The present invention also provides for a method for the erection of the hereinbefore described retaining wall system 20 to retain a target volume 136 of fill material 22. Such method firstly comprises the steps of drilling a plurality footing holes 126 in seriatim to a selected depth 62 at positions selected to accommodate the installation of a plurality of retaining wall panels 24 of determinate length, each said wall panel 24 having a plurality of mounting brackets 38 embedded therein which protrude from a fill contacting face 28 of the wall panel 24 in one or more horizontal rows.

The depth of the footing holes 126 is selected in accordance with calculations conducted in accordance with known engineering principles having regard to the construction of the retaining wall 122, the nature of the fill 22, the number and nature of the anchoring means 52 employed and the purposes for which the retaining wall 122 is installed, such that the footing holes 126 extend beneath a notional slip circle radius 146 for the wall system 20 that provides acceptable design levels of stability with respect to slip circle type failure. It is preferable that the drilling of the footing holes 126 take place in a relatively continuous fashion so as to minimize the length of time that specialized drilling equipment is required on site.

The next step entails the pouring of fluid concrete into said footing holes 126 to form a corresponding plurality of concrete footings 60, and thereafter inserting a first end 42 of one of a plurality of I-beam support columns 40 into the fluid concrete in each said footing 60. Each I-beam support column 40 has two parallel flanges 54 and a traverse web 56 extending therebetween, and is inserted in substantially vertical orientation in the footing 60 and directed such that the web 56 of each said I-beam support column 40 is substantially parallel to the web 56 of every other I-beam support column 40 and is substantially normal to a notional wall line 58 defined by the plurality of footing holes 126.

Following the installation of the I-beam support columns 40, a plurality of retaining wall panels 24 are inserted, in seriatim, each said wall panel 24 being inserted between the flanges 54 of adjacent I-beam support columns 40 such that the fill contacting face 28 is oriented towards the target volume 136, the plurality of wall panels 24 so inserted forming a retaining wall 122 of selected height and length, said retaining wall 122 having a slope facing side 134 defined by the plurality of fill contacting faces 28 of the wall panels 24.

It is preferable that the previously described steps, relating to the installation of the frame members 40 and wall panels 24 take place in a relatively continuous fashion, so as to minimize the length of time that specialized lifting equipment is required on site.

Preferably, following the insertion of the wall panels 24, spacers 156 are also inserted in vertical orientation operatively abutting the exposed faces 26 of the wall panels 24, adjacent their first 30 and second lateral ends 32, as seen in FIG. 5. Such spacers 156 are not strictly required, however, the use of same allows for additional clearance between the parallel flanges 54 and the wall panels 24, such additional clearance enabling said wall panels 24 to be inserted between the flanges 54 more easily.

Optionally, following the insertion of the wall panels 24, drainage piping 64 is laid adjacent to the slope facing side 134 of the retaining wall 122 at a horizontal level 66 adjacent an upper end 124 of the concrete footing 60 of each frame member 40.

Thereafter, there is installed and compacted a first layer of fill material 128 abutting the slope facing side 134 of the retaining wall 122, to the approximate horizontal level of a selected row 138 of said mounting brackets 38.

Next, a plurality of connecting means 46, each having a proximal end 48 and a distal end 50, are secured at their respective proximal ends 48 to said selected row 138 of mounting brackets 38, the distal end 50 of each connecting means 46 is secured to a respective one of a plurality of anchoring means 52, such that all anchoring means 52 are secured to at least a respective one of said connecting means 46 and a further layer of fill material 140 is then installed and compacted to a level 150 above the connecting means 46 so secured, which step is sequentially repeated until the target volume 136 of fill 22 is retained behind the retaining wall system 20.

Following such previous step, the retaining wall 122, per se, is complete. However, the retaining wall system 20 provides that, optionally, Jersey type barrier panels 106 may then be positioned atop the retaining wall 122 in vertically stacked relation thereto, in lateral end-to-end relation to one another, separated one from another respectively by said frame members 40, each said Jersey barrier 106 being inserted between the flanges 54 of adjacent I-beam support columns 40 to form a continuous Jersey type barrier 130 of selected lateral length.

Alternatively, the retaining wall system 20 also provides the option of positioning a plurality of retaining wall panels 24 atop a Jersey barrier 130 in vertically stacked relation to one another and to said Jersey barrier 130, and, separated one from another respectively by said frame members 40, in lateral relation to one another, so as to form a retaining wall 122 of selected length and height, with a plurality of acoustic panels 112 being thereafter positioned atop said retaining wall 122 in vertically stacked relation to one another and to said retaining wall 122, and, separated one from another respectively by said frame members 40, in lateral relation to one another, so as to form an acoustic barrier of selected length and height.

It should be noted that with respect to the selection process referred to above relating to rows of mounting brackets 38, such selection is conducted is accordance with recognized engineering principles, having regard to the height of the retaining wall 122, the nature of the fill material 22, the expected loading of the target volume 136 and the expected loading of the retaining wall 122 itself. Careful calculations with respect to the number and placement of such connecting means 46 and anchoring means 52 will permit the top tier 142 of the plurality of wall panels 24 not be anchored into the fill 22 with anchoring means 52 and connecting means 46, with the result that the uppermost level 144 of connecting means 46 will be sufficiently below the top level 148 of the fill material 22 to avoid interference with normal surface servicing (example tree planting, underground piping and wiring) and surface usage. Alternatively, where anchoring of a row or rows of mounting brackets would require excavation, in circumstances where excavation is not desired for cost or other reasons, such as the location of underground wiring or plumbing, careful calculations with respect to the number and placement of such connecting means and anchoring means will permit said row or rows not to be anchored into the fill (not shown).

I claim:

1. An improved retaining wall system (20) for use with granular fill (22), said improved retaining wall system (20) being of the type having:

a plurality of wall panels (24) each having an exposed face (26), a fill contacting face (28), a first lateral end (30), a second lateral end (32), an upper panel surface (34), a lower panel surface (36) and a plurality of mounting brackets (38) protruding from the fill contacting face (28) thereof;

at least two upright frame members (40) in the form of I-beam support columns, each such column (40) having two parallel flanges (54) and a transverse web (56) extending therebetween, and being positioned such that its web (56) is substantially parallel to the web (56) of every other frame member (40) and is substantially normal to a notional wall line (58) defined by the plurality of frame members (40), each of said upright frame members (40) having a first end (42) secured within the ground (43) and a second end (44) vertically disposed thereto, said frame members (40) being positioned and dimensioned to support said retaining wall panels (24) in mechanically retained vertical orientation therebetween;

said plurality of wall panels (24) being positioned in vertically stacked relation to one another, and being laterally separated one from another respectively by said frame members (40), in lateral relation to one another, so as to form a retaining wall (122) of selected height and length, wherein the improvement is characterized by:

a plurality of non-rigid connecting means (46), and a plurality of anchoring means (52) each having an anchoring flange (84) directed along a plane substantially parallel to the plane of said fill contacting face (28), with each such non-rigid connecting means (46) having a proximal end (48) secured to a respective one of said mounting brackets (38) on the fill contacting face (28) and extending outwardly therefrom to a distal end (50) secured to a respective one of said anchoring means (52), with all anchoring means (52) being secured to at least a respective one of said non-rigid connecting means (46), wherein a plurality of reinforcing means (68) are positioned within each wall panel (24), wherein each said mounting bracket (38) comprises a metal tie (38) embedded within the wall panel (24) in mechanically retained wrapped engagement around at least a respective one of said plurality of reinforcing means (68) cast therein, each said mounting bracket (38) having a protruding end (76) protruding from said wall panel (24), and wherein the non-rigid connecting means (46) comprise metal straps, said metal straps being flat in cross-section.

2. A retaining wall system (20) according to claim 1, wherein one or more of said wall panels (24) are constructed from cementitious materials, and wherein said one or more wall panels (24) so constructed each comprise one or more layers (96) of chemically mineralized and neutralized fibres blended with Portland cement.

3. A retaining wall system (20) according to claim 2, wherein said one or more layers (96) of chemically mineralized and neutralized fibres blended with Portland cement constitutes an exposed face layer (96) of said one or more of said wall panels (24).

4. A retaining wall system (20) according to claim 1, wherein one or more of said wall panels (24) are constructed from chemically mineralized and neutralized fibres blended with Portland cement.

5. A retaining wall system (20) according to claim 1, wherein one or more of said wall panels (24) each further comprises a weeping means (74).

6. A retaining wall system (20) according to claim 5, wherein said weeping means (74) comprises at least one plug (74) of chemically mineralized and neutralized fibres blended with Portland cement and cast contiguously with each of said one or more of said wall panels (24) so as to extend therethrough from the fill contacting face (28) to the exposed face (26) thereof.

7. A retaining wall system (20) according to claim 6, wherein the weeping means (74) comprises two of said plugs (74) of chemically mineralized and neutralized fibres blended with Portland cement.

8. A retaining wall system (20) according to claim 1, wherein each frame member (40) is secured within the ground (43) by containment within one of a respective plurality of concrete footings (60), said concrete footings (60) extending into the ground (43) to a selected depth.

9. A retaining wall system (20) according to claim 8, further comprising a continuous network of drainage piping (64) adjacent to said wall line (58) and at a horizontal level (66) adjacent an upper end (124) of the concrete footing (60) of each frame member (40).

10. A retaining wall system (20) according to claim 1, wherein the wall panels (24) are retained in their respective positions from lateral movement by the webs (56) of adjacent frame members (40) and retained from movement away from said wall line (58) by the flanges (54) of said frame members (40).

11. A retaining wall system (20) according to claim 1, wherein each wall panel (24) has an upwardly disposed panel tongue (70) extending along its upper panel surface (34) and a corresponding panel groove (72) extending along its lower panel surface (36), and wherein the panel tongues (70) and panel grooves (72) are rigidly engageable.

12. A retaining wall system (20) according to claim 11, further comprising compression means (98) positioned between vertically adjacent wall panels (24).

13. A retaining wall system (20) according to claim 12, wherein the panel tongue (70) of each said wall panel (24) has an upper tongue surface (100) and wherein said compression means (98) comprises a seam bearing pad (102) extending along said upper tongue surface (100) and being constructed of strong and compressible material.

14. A retaining wall system (20) according to claim 12, wherein said compression means (98) comprises two end bearing pads (104), positioned upon the upper panel surface (34) adjacent to the first lateral end (30) and the second lateral end (32) and being constructed of strong and compressible material.

15. A retaining wall system (20) according to claim 1, wherein each said anchoring means (52) comprises a bar of substantially T-shaped cross-section defining two of said anchoring flanges (84), each of said anchoring flanges (84) being oriented normally to a connecting flange (86) of said anchoring means (52).

16. A retaining wall system (20) according to claim 15, wherein each of the mounting brackets (38) has, adjacent its protruding end (76), an opening (88) therethrough sized and dimensioned to receive a first fastening means (90).

17. A retaining wall system (20) according to claim 16, wherein each of the non-rigid connecting means (46) has, adjacent each of its proximal (48) and distal (50) ends, an opening (92) therethrough sized and dimensioned to receive a first fastening means (90).

18. A retaining wall system (20) according to claim 17, wherein each connecting flange (86) has a centrally disposed opening (94) therethrough sized and dimensioned to receive a first fastening means (90).

19. A retaining wall system (20) according to claim 18, wherein the proximal end (48) of each non-rigid connecting means (46) is secured to a respective one of said mounting brackets (38) by a first fastening means (90), and the distal end (50) of each non-rigid connecting means (46) is secured to a respective one of said anchoring means (52) by a first fastening means (90).

20. A retaining wall system (20) according to claim 19, wherein the distal end (50) of each non-rigid connecting means (46) is secured to a respective one of said anchoring means (52) by a first fastening means (90), with said distal end (50) operatively abutting the anchoring flange (84) so as to prevent pivotal rotation of said anchoring means (52) about said first fastening means (90).

21. A retaining wall system (20) according to claim 20, wherein the anchoring means (52), first fastening means (90), frame members (40), mounting brackets (38) and non-rigid connecting means (46) are constructed from galvanized metal.

22. A retaining wall system (20) according to claim 1, further comprising a plurality of Jersey barriers (106), each said Jersey barrier (106) being adapted for sliding, retained insertion between adjacent frame members (40) so as to be retained in their respective positions from lateral movement by the webs (56) of adjacent frame members (40) and retained from movement away from said wall line (58) by the flanges (54) of said frame members (40) in lateral end-to-end relation to one another, and wherein said plurality of wall panels (24) are positioned in vertically stacked relation to one another as aforesaid above respective ones of the Jersey barriers (106).

23. A retaining wall system (20) according to claim 1, further comprising a plurality of Jersey barriers (106) positioned atop the retaining wall (122) in vertically stacked relation thereto, each said Jersey barrier (106) being adapted for sliding, retained insertion between adjacent frame members (40) so as to be retained in their respective positions from lateral movement by the webs (56) of adjacent frame members (40) and retained from movement away from said wall line (58) by the flanges (54) of said frame members (40) atop said retaining wall (122) in lateral end-to-end relation to one another.

24. A retaining wall system (20) according to claim 1, further comprising a plurality of acoustic panels (112) positioned atop the retaining wall (122), each said acoustic panel (112) being adapted for sliding, retained insertion between adjacent frame members (40) so as to be retained in their respective positions from lateral movement by the webs (56) of adjacent frame members (40) and retained from movement away from said wall line (58) by the flanges (54)

of said frame members (40) atop said retaining wall (122) in lateral end-to-end relation to one another.

25. An improved retaining wall system (20) for use with granular fill (22), said improved retaining wall system (20) being of the type having:

a plurality of wall panels (24) each having an exposed face (26), a fill contacting face (28), a first lateral end (30), a second lateral end (32), an upper panel surface (34), a lower panel surface (36) and a plurality of mounting brackets (38) protruding from the fill contacting face (28) thereof;

at least two upright frame members (40) in the form of I-beam support columns, each such column (40) having two parallel flanges (54) and a transverse web (56) extending therebetween, and being positioned such that its web (56) is substantially parallel to the web (56) of every other frame member (40) and is substantially normal to a notional wall line (58) defined by the plurality of frame members (40), each of said upright frame members (40) having a first end (42) secured within the ground (43) and a second end (44) vertically disposed thereto, said frame members (40) being positioned and dimensioned to support said retaining wall panels (24) in mechanically retained vertical orientation therebetween;

said plurality of wall panels (24) being positioned in vertically stacked relation to one another, and being laterally separated one from another respectively by said frame members (40), in lateral relation to one another, so as to form a retaining wall (122) of selected height and length, wherein the improvement is characterized by:

a plurality of non-rigid connecting means (46), and a plurality of anchoring means (52) each having an anchoring flange (84) directed along a plane substantially parallel to the plane of said fill contacting face (28), with each such non-rigid connecting means (46) having a proximal end (48) secured to a respective one of said mounting brackets (38) on the fill contacting face (28) and extending outwardly therefrom to a distal end (50) secured to a respective one of said anchoring means (52), with all anchoring means (52) being secured to at least a respective one of said non-rigid connecting means (46), wherein each wall panel (24) has an upwardly disposed panel tongue (70) extending along its upper panel surface (34) and a corresponding panel groove (72) extending along its lower panel surface (36), and wherein the panel tongues (70) and panel grooves (72) are rigidly engageable, wherein the retaining wall system (20) further comprises compression means (98) positioned between vertically adjacent wall panels (24), wherein the panel tongue (70) of each said wall panel (24) has an upper tongue surface (100) and wherein said compression means (98) comprises a seam bearing pad (102) extending along said upper tongue surface (100) and being constructed of strong and compressible material, and wherein said seam bearing pad (102) is constructed of chemically mineralized and neutralized fibres blended with Portland cement, and is cast contiguously with said wall panel (24).

26. A retaining wall system (20) according to claim 25, wherein a plurality of reinforcing means (68) are positioned within each wall panel (24).

27. A retaining wall system (20) according to claim 26, wherein the plurality of reinforcing means (68) comprise a plurality of reinforcing bars (68).

28. A retaining wall system (20) according to claim 26, wherein each said mounting bracket (38) comprises a metal tie (38) embedded within the wall panel (24) in mechanically retained wrapped engagement around at least a respective one of said plurality of reinforcing means (68) cast therein, each said mounting bracket (38) having a protruding end (76) protruding from said wall panel (24).

29. An improved retaining wall system (20) for use with granular fill (22), said improved retaining wall system (20) being of the type having:

a plurality of wall panels (24) each having an exposed face (26), a fill contacting face (28), a first lateral end (30), a second lateral end (32), an upper panel surface (34), a lower panel surface (36) and a plurality of mounting brackets (38) protruding from the fill contacting face (28) thereof;

at least two upright frame members (40) in the form of I-beam support columns, each such column (40) having two parallel flanges (54) and a transverse web (56) extending therebetween, and being positioned such that its web (56) is substantially parallel to the web (56) of every other frame member (40) and is substantially normal to a notional wall line (58) defined by the plurality of frame members (40), each of said upright frame members (40) having a first end (42) secured within the ground (43) and a second end (44) vertically disposed thereto, said frame members (40) being positioned and dimensioned to support said retaining wall panels (24) in mechanically retained vertical orientation therebetween;

said plurality of wall panels (24) being positioned in vertically stacked relation to one another, and being laterally separated one from another respectively by said frame members (40), in lateral relation to one another, so as to form a retaining wall (122) of selected height and length, wherein the improvement is characterized by:

a plurality of non-rigid connecting means (46), and a plurality of anchoring means (52) each having an anchoring flange (84) directed along a plane substantially parallel to the plane of said fill contacting face (28), with each such non-rigid connecting means (46) having a proximal end (48) secured to a respective one of said mounting brackets (38) on the fill contacting face (28) and extending outwardly therefrom to a distal end (50) secured to a respective one of said anchoring means (52), with all anchoring means (52) being secured to at least a respective one of said non-rigid connecting means (46), wherein each wall panel (24) has an upwardly disposed panel tongue (70) extending along its upper panel surface (34) and a corresponding panel groove (72) extending along its lower panel surface (36), and wherein the panel tongues (70) and panel grooves (72) are rigidly engageable, wherein the retaining wall system (20) further comprises compression means (98) positioned between vertically adjacent wall panels (24), wherein said compression means (98) comprises two end bearing pads (104), positioned upon the upper panel surface (34) adjacent to the first lateral end (30) and the second lateral end (32) and being constructed of strong and compressible material, and wherein the end bearing pads (104) are constructed of chemically mineralized and neutralized fibres blended with Portland cement, and are cast contiguously with said wall panel (24).

30. An improved retaining wall system (20) for use with granular fill (22), said improved retaining wall system (20) being of the type having:

a plurality of wall panels (24) constructed from cementitious materials and each having an exposed face (26), a fill contacting face (28), a first lateral end (30), a second lateral end (32), an upper panel surface (34), a lower panel surface (36) and a plurality of mounting brackets (38) protruding from the fill contacting face (28) thereof;

at least two upright frame members (40) in the form of I-beam support columns, each such column (40) having two parallel flanges (54) and a transverse web (56) extending therebetween, and being positioned such that its web (56) is substantially parallel to the web (56) of every other frame member (40) and is substantially normal to a notional wall line (58) defined by the plurality of frame members (40), each of said upright frame members (40) having a first end (42) secured within the ground (43) and a second end (44) vertically disposed thereto, said frame members (40) being positioned and dimensioned to support said retaining wall panels (24) in mechanically retained vertical orientation therebetween;

said plurality of wall panels (24) being positioned in vertically stacked relation to one another, and being laterally separated one from another respectively by said frame members (40), in lateral relation to one another, so as to form a retaining wall (122) of selected height and length;

wherein the improvement is characterized by:

one or more of said wall panels (24) each comprising a weeping means (74), said weeping means (74) comprising at least one plug 74 of chemically mineralized and neutralized fibres blended with Portland cement and cast contiguously with said each of said one or more of said wall panels (24) so as to extend therethrough from the fill contacting face (28) to the exposed face (26) thereof.

31. A retaining wall system (20) according to claim 30 wherein said wall panels (24) have one or more discrete layers (96) of said chemically mineralized and neutralized fibres blended with Portland cement.

32. A retaining wall system (20) according to claim 31, wherein said one or more discrete layers (96) constitutes an exposed face layer (96) of said one or more of said wall panels (24).

* * * * *